US006352094B1

(12) United States Patent
Gunderson et al.

(10) Patent No.: US 6,352,094 B1
(45) Date of Patent: Mar. 5, 2002

(54) MODULAR LABEL DISPENSING APPARATUS

(75) Inventors: Ernest M. Gunderson, Minneapolis; Mark E. Conley, Woodbury; Jason F. Ehde, Stillwater; Russell A. Janke, Wyoming; Craig A. Blonigen, Brooklyn Park, all of MN (US)

(73) Assignee: Lowry Computer Products, Inc., Brighton, MI (US)

( * ) Notice: Subject to any disclaimer, the term of this patent is extended or adjusted under 35 U.S.C. 154(b) by 0 days.

(21) Appl. No.: 09/354,027

(22) Filed: Jul. 15, 1999

(51) Int. Cl.[7] ..... B65C 9/18; B65C 9/08

(52) U.S. Cl. ..... 156/361; 156/541; 156/542; 156/DIG. 33

(58) Field of Search ..... 156/361, 363, 156/362, 364, 540, 541, 542, DIG. 33, 350, DIG. 28

(56) References Cited

U.S. PATENT DOCUMENTS 4,106,972 A * 8/1978 Caudill ..... 156/363
4,294,644 A * 10/1981 Anderson ..... 156/361
4,832,783 A * 5/1989 Nechay et al. ..... 156/448
4,954,203 A * 9/1990 Matsumoto ..... 156/361
5,061,334 A 10/1991 Paules
5,232,539 A 8/1993 Carpenter et al.
5,300,181 A * 4/1994 Yamaguchi ..... 156/542
5,660,676 A * 8/1997 Brooks ..... 156/361
6,199,614 B1 * 3/2001 Snyder et al. ..... 156/387

* cited by examiner

*Primary Examiner*—Richard Crispino
*Assistant Examiner*—Sue A. Purvis
(74) *Attorney, Agent, or Firm*—Harness, Dickey & Pierce, P.L.C.

(57) ABSTRACT

A label dispensing apparatus is provided for applying labels to advancing articles. The label dispensing apparatus features a modular design that couples different types of label dispensing modules to one of several label applicators through a standard chassis. An apply-only label dispensing module for use in the apparatus includes a primary drive roller mechanism receptive of a label web being supplied from the label dispensing chassis and capable of advancing the label web along a web path; a peeler wedge positioned downstream in the web path from the primary drive mechanism, such that the label web traverses the peeler wedge to separate the labels from the label web; a secondary drive roller mechanism positioned downstream from the peeler wedge for advancing the label web along the web path and for maintaining tension on the label web; and a drive mechanism connected to the primary drive roller and the secondary drive roller for providing rotary motion to each of the primary drive roller and the secondary drive roller, thereby advancing the label web along the web path.

10 Claims, 8 Drawing Sheets

MODULAR LABEL DISPENSING APPARATUS

BACKGROUND OF THE INVENTION

1. Field of the Invention

The present invention relates generally to a label dispensing apparatus and, more particularly, to an apply-only label dispensing module for use in a conventional print-and-apply label dispensing chassis.

2. Discussion

Label dispensing units for applying labels to advancing articles have come into widespread use in a variety of industries. Print-and-apply label dispensing systems are today's cost-effective solution for labeling products, cartons, cases and pallets. Generally, these types of systems feature a unique modular design that couples a variety of commercially available print engine modules to one of several label applicators through a standard chassis. In operation, the print-and-apply label dispensing system produces high quality, "on-demand" labels and applies them automatically in a single, easy operation to an advancing article. Exemplary print engine modules are commercially available from Sato America, Inc. of Sunnyvale, Calif., Zebra Technologies, Inc. of Vernon Hills, Ill. and Datamax Corporation of Orlando, Fla.

Despite the flexibility provided by a print-and-apply label dispensing system, some high speed operations are more suited for an "apply-only" labeling system. Apply-only systems utilize pre-printed labels, and thus are able to apply labels to advancing articles at higher rates than print-and-apply systems. Therefore, a need exists for an apply-only label dispensing module that can be easily integrated with the standard chassis of the conventional print-and-apply label dispensing system. By exploiting the modularity of the standard chassis, the apply-only module best fits certain high speed labeling applications of a specific production environment, while reducing costs of providing an overall label dispensing system. However, the present invention must also be designed to account for the slower rates associated with the standard chassis.

SUMMARY OF THE INVENTION

A label dispensing apparatus is provided for applying labels to advancing articles. The label dispensing apparatus features a modular design that couples different types of label dispensing modules to one of several label applicators through a standard chassis. In accordance with the present invention, an "apply-only" label dispensing module includes a primary drive roller mechanism receptive of a label web being supplied from the label dispensing chassis and capable of advancing the label web along a web path; a peeler wedge positioned downstream in the web path from the primary drive mechanism, such that the label web traverses the peeler wedge to separate the labels from the label web; a secondary drive roller mechanism positioned downstream from the peeler wedge for advancing the label web along the web path and for maintaining tension on the label web; and a drive mechanism connected to the primary drive roller and the secondary drive roller for providing rotary motion to each of the primary drive roller and the secondary drive roller, thereby advancing the label web along the web path.

Additional benefits and advantages of the present invention will become apparent to those skilled in the art to which this invention relates from a reading of the subsequent description of the preferred embodiment and the appended claims, taken in conjunction with the accompanying drawings.

DETAILED DESCRIPTION OF THE PREFERRED EMBODIMENT

Figure 1:
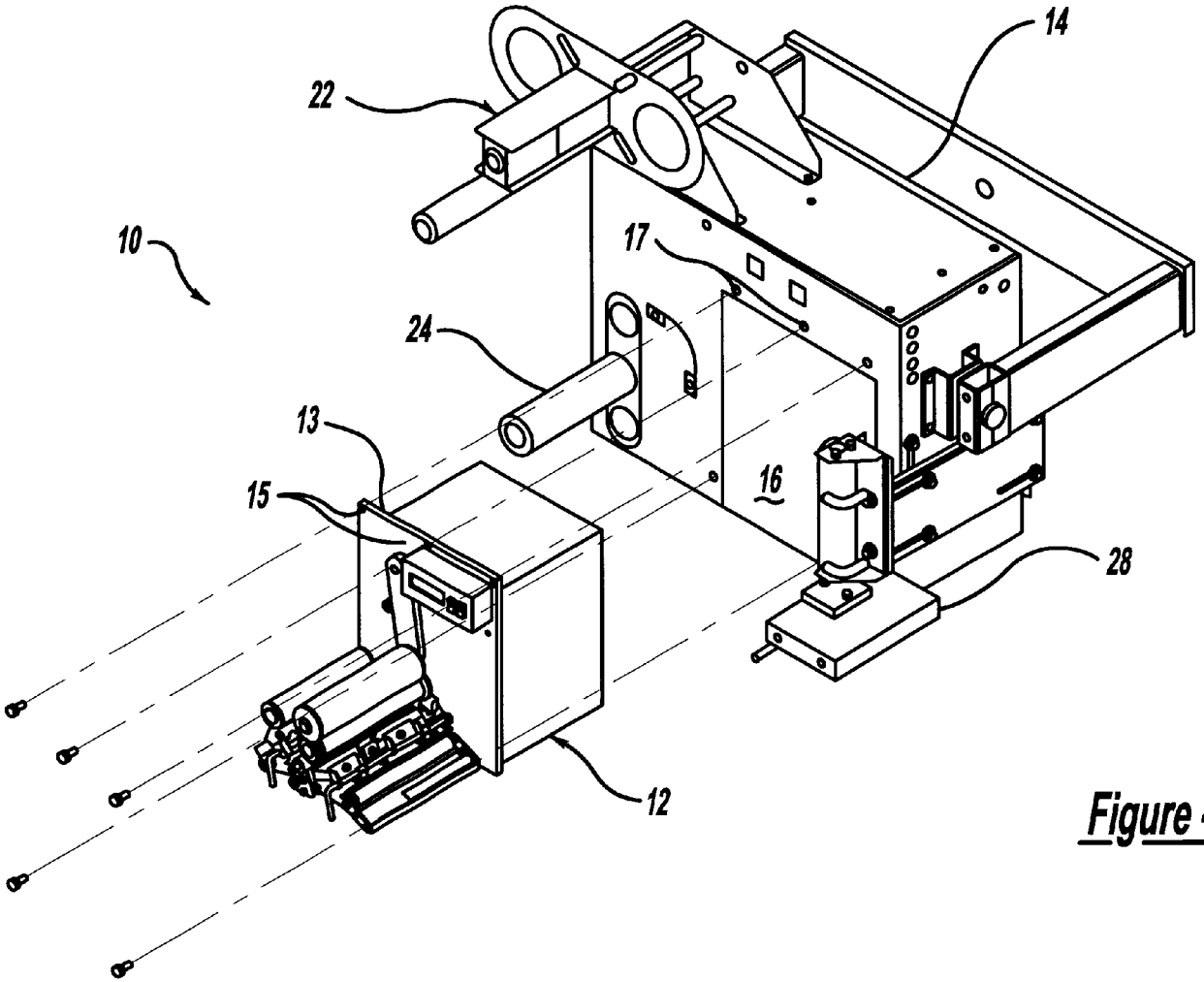
FIG. 1 is an exploded perspective view of a label dispensing module and a label dispensing chassis in accordance with the present invention.

A label dispensing apparatus 10 in accordance with the present invention is depicted in FIG. 1. The apparatus 10 includes an apply-only label dispensing module 12 and a label dispensing chassis 14. The label dispensing chassis 14 provides a rectangular opening 16 that is used to house the label dispensing module 12. As shown in FIG. 1, a mounting flange 13 the label dispensing module 12 is designed with a hole pattern 15 which facilitates it being bolted into an opening 16 via a similar hole pattern 17 on a face of the chassis 14. One skilled in the art will readily recognize that other connector means may be used to releasably couple the module 12 to the chassis 14. In this way, a conventional print engine or print-and-apply module can be easily replaced by the label dispensing module 12. Although the Paragon system from Marprint, Inc. of White Bear Lake, Minn. is the presently preferred label dispensing chassis 14, this is not intended as a limitation of the invention. On the contrary, the present invention is applicable to other commercially available label dispensing chassis.

Figure 2:
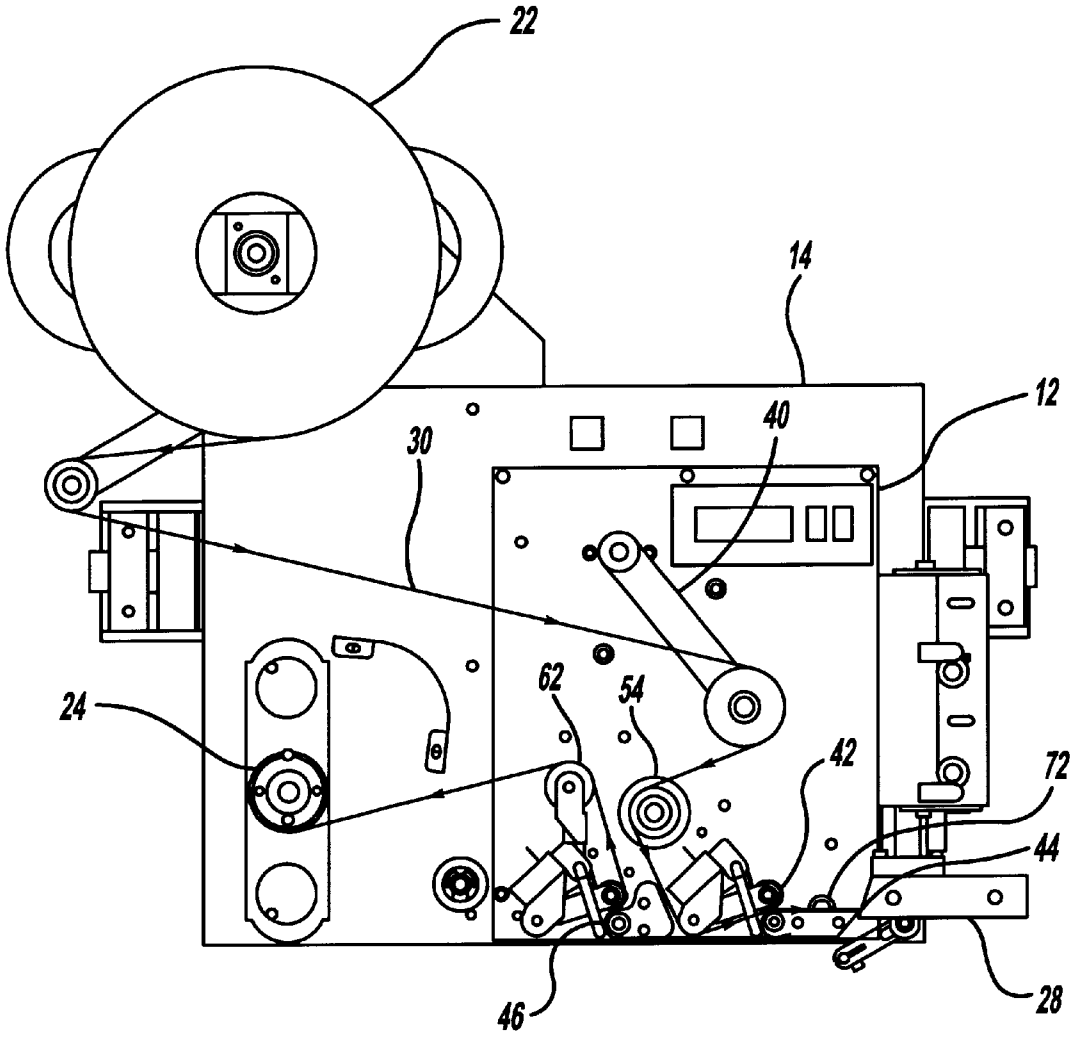
FIG. 2 is a side view of the label dispensing module mounting into the label dispensing chassis in accordance with the present invention.

In order to support a print-and-apply module, the chassis 14 includes a label supply hub 22, a web rewind hub 24, a drive mechanism 64 (shown in FIG. 7) and a label applicator 28. As shown in FIG. 2, a roll of labels easily mounts onto the label supply hub 22, whereby it provides a label web 30 for the label dispensing apparatus 10. The label web 30 can then be threaded along a web path until it attaches to the web rewind hub 24. The web rewind hub 24 is used to accumulate the label web 30. To advance the label web 30, a drive mechanism (not shown) provides rotary motion to the web rewind hub 24.

A microcontroller (not shown) is typically used to control the drive mechanism as well as other various functions associated with the label dispensing apparatus 10. A brake may also be used in conjunction with the label supply hub 22 to prevent unravel of the label web 30. The chassis 14 further includes a power supply (not shown) which serves as a source of power for the microcontroller.

A standard tamp applicator 28 for applying labels to advancing articles is also controlled by the microcontroller.

A label is dispensed from the label dispensing module 12 to the applicator 28 as will be more fully explained below. Thus, the label is positioned onto a vacuum pad of the applicator 28. When an advancing article is detected, an air cylinder engages, causing the pad to come in momentary contact with the advancing article, thereby applying the label. The air cylinder may also engage at periodic time intervals which coincides with the speed of the conveyor being used to transport the advancing articles. The air cylinder then retracts and the next label is dispensed onto the pad. Depending on the configuration of the advancing article and the specific labeling requirements, it is envisioned that other types of applicators, including a dual tamp applicator, a vacuum blow applicator, a roll on applicator, and a corner wrap applicator, may also be used in conjunction with the chassis 14. While the above description is provided with reference to a particular label dispensing chassis, it is readily 20 understood that this explanation is merely an overview of the basic chassis components. As will be apparent to one skilled in the art, additional components as well as other configurations for these components are within the scope of the present invention.

Figure 3:
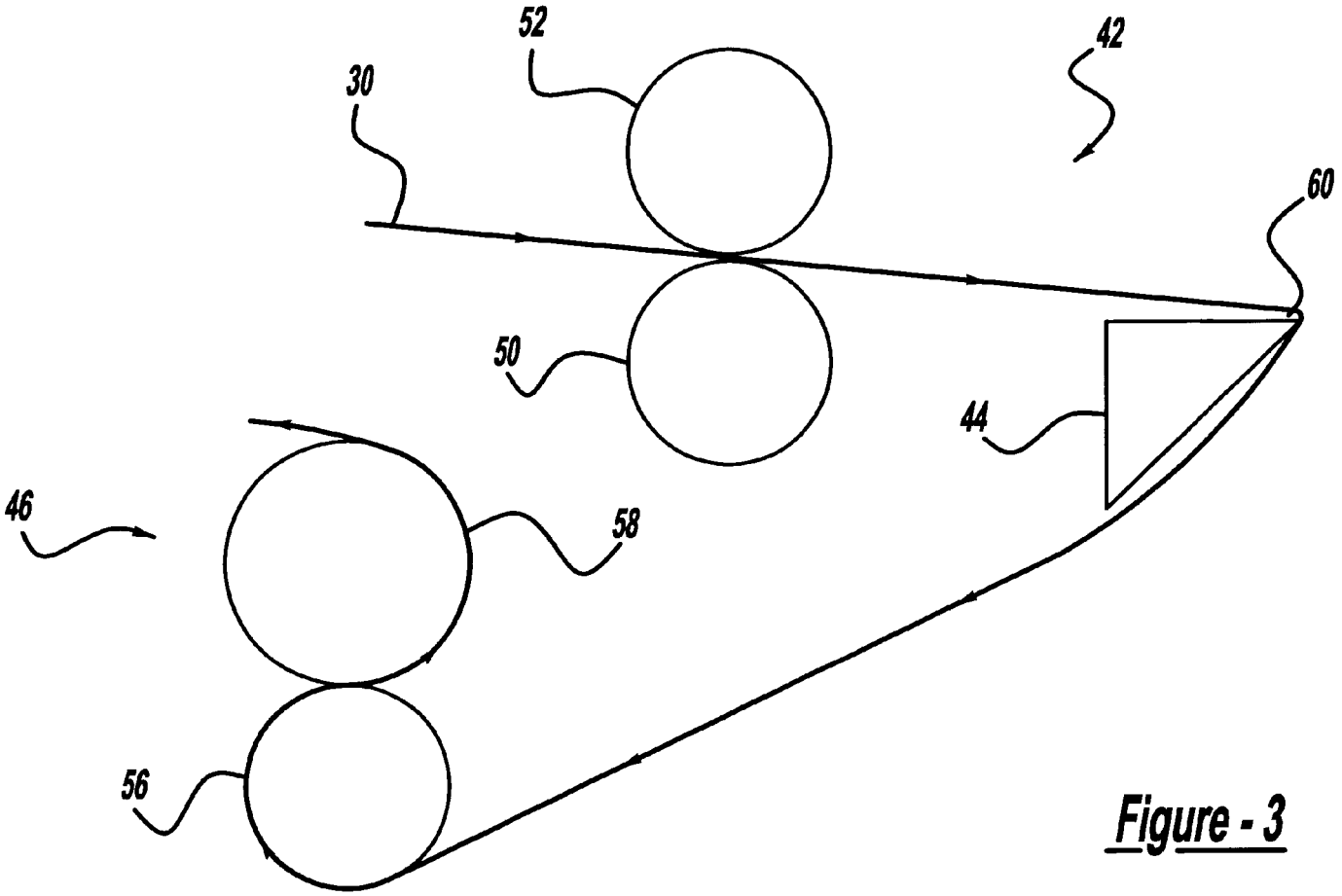
FIG. 3 is a diagram showing the primary components of the label dispensing module of the present invention.
Figure 4:
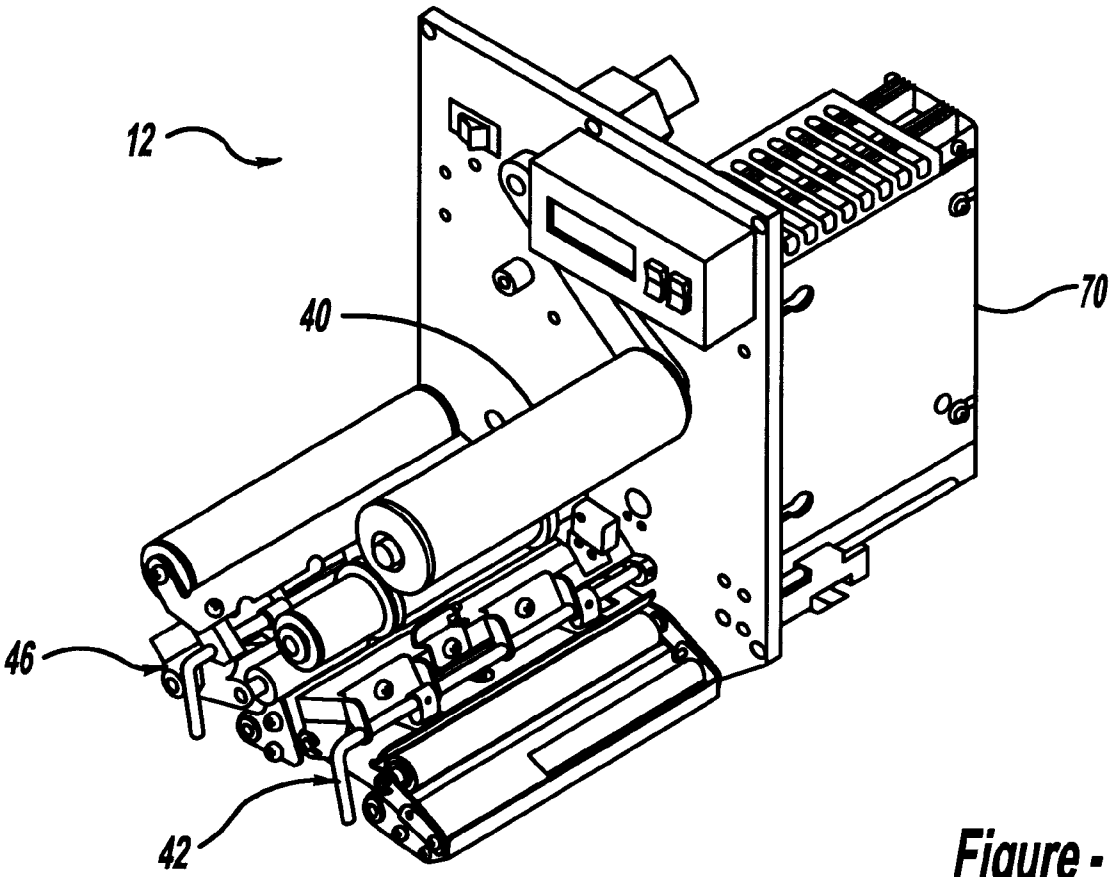
FIG. 4 is a front perspective view of the label dispensing module of the present invention.
Figure 5A:
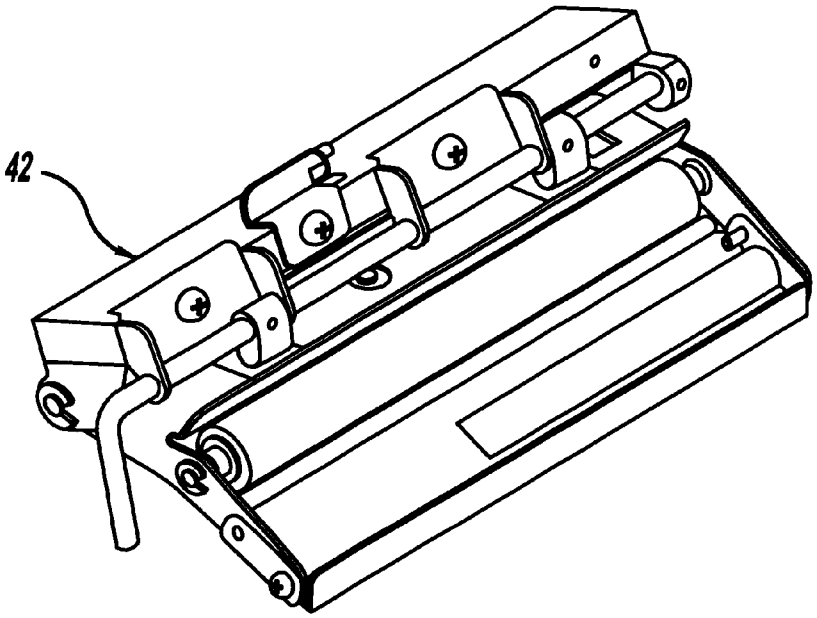
FIGS. 5A and 5B are top and bottom perspective views, respectively, of a primary drive roller mechanism of the present invention.
Figure 5B:
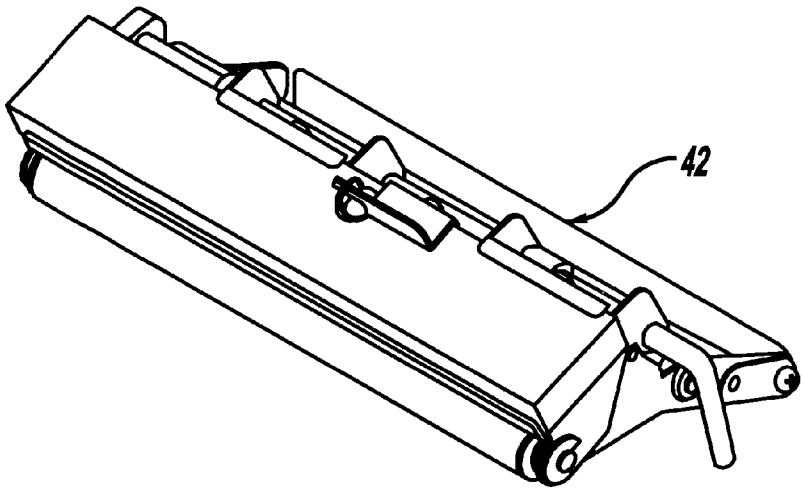
Figure 7:
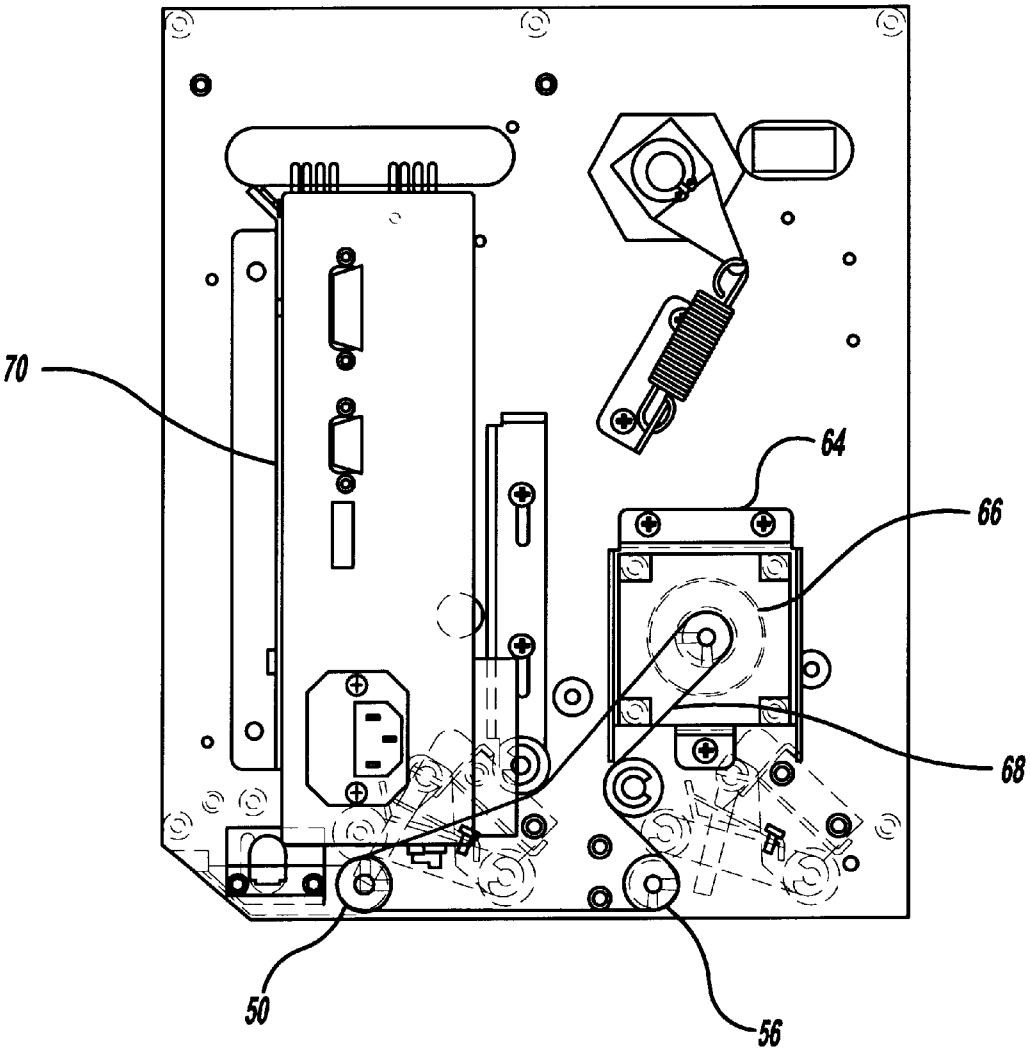
FIG. 7 is a rear view of the label dispensing module of the present invention.

Referring to FIGS. 2, 3 and 4, the apply-only label dispensing module 12 of the present invention includes a secondary dancer arm 40, a primary drive roller mechanism 42, a peeler wedge 44, and a secondary drive roller mechanism 46. The label web 30 from the label supply hub 22 is received on the module 12 by the secondary dancer arm 40. The dancer arm 40 pivotally connects to the module 12 and moves within a range of positions based on the tension of the label web 30. To do so, the dancer arm is spring loaded as shown in FIG. 7. In this way, the dancer arm 40 supports the different operating speeds of module 12. The primary drive roller mechanism 42 in turn receives the label web 30 from the secondary dancer arm 40. The primary drive roller mechanism 42 is further defined as a primary drive roller 50 and a primary pinch roller 52 which operate collaboratively to advance the label web 30. A first intermediate roller(s) 54 may also be disposed between the secondary dancer arm 40 and the primary roller mechanism 42 to guide the label web 30 along the web path 32. The primary drive roller mechanism 42 is also shown in FIGS. 5A and 5B.

Figure 6A:
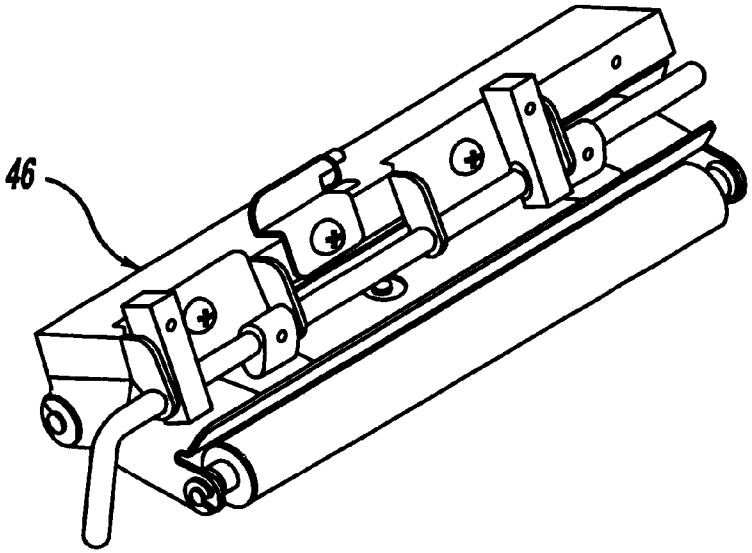
FIGS. 6A and 6B are top and bottom perspective views, respectively, of a secondary drive roller mechanism of the present invention.
Figure 6B:
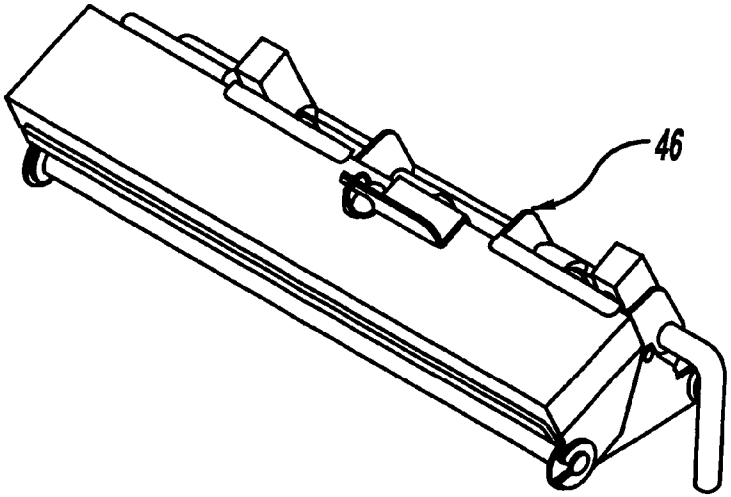

The secondary drive roller mechanism 46 receives the label web 30 from the primary roller mechanism 42 and is further defined as a secondary drive roller 56 and a secondary pinch roller 58. Again, the secondary drive roller 56 and the secondary pinch roller 58 operate collaboratively to advance the label web 30 along the web path. The peeler wedge 44 is positioned in the web path between the primary drive roller mechanism 42 and the secondary drive roller mechanism 46. Labels are separated from the webbing as the label web 30 traverses an edge 60 of the peeler wedge 44. As is well known in the art, the edge 60 is formed with a radius on the order of 0.030 inches. The secondary drive roller mechanism 46 is also shown in FIGS. 6A and 6B.

To further guide the label web 30 along the web path 32, a second intermediate or dampener roller(s) 62 may also be disposed between the secondary drive roller mechanism 46 and the web rewind roller 24. The dampener roller 62 pivotally connects to the module 12 and moves within a range of positions based on the tension of the label web 30. As the web rewind roller 24 pulls the label web 30, the dampener roller 62 absorbs any "jerky" motion in the label web 30.

A drive mechanism 64 is connected to each of the primary drive roller 50 and the secondary drive roller 56 as shown in FIG. 7. In a preferred embodiment, the drive mechanism 64 comprises a stepper motor 66 connected via a timing belt 68 to each of the drive rollers. The timing belt passes over a timing pulley on the end of each roller and over a standing pulley on the stepper motor. In this way, the stepper motor 66 provides rotary motion to each of the primary drive roller 50 and the secondary drive roller 56.

Thus, the primary drive roller mechanism 42 pulls the label web 30 from the label supply hub 22 and the secondary drive roller mechanism 46 provides a tension on the label web 30. The labels are separated from the webbing as the label web 30 traverses an edge 60 of the peeler wedge 44. To maintain the tension on the label web 30, the diameter of the secondary drive roller 56 is designed slightly larger (e.g., 0.010") than the diameter of the primary drive roller 50. In effect, the secondary drive roller 56 is moving further than the primary drive roller 50, even though they rotate at exactly the same revolutions per minute. As long as the tension is maintained on the label web 30, the labels separate from the webbing and continue forward onto the suction pad of the applicator 28. The label can then be applied by the applicator 28 to an advancing article.

In a conventional print-and-apply label dispensing system, the label web 30 can travel at a rate up to 10 inches per second. In this case, the web rewind hub 24 is driven by the drive mechanism associated with the chassis 14. However, an apply-only label dispensing module advances the label web at much faster rates (e.g., as much as 24 inches per second). Thus, the web rewind hub 24 needs to be driven faster than the traditional 10" per second. To accomplish this, a larger drive pulley is used on the drive mechanism of the chassis 14.

In a preferred mode of operation, a microcontroller 70 residing on the label dispensing module 12 is used to control the operation of the drive mechanism 64. A label detection sensor 72 may be placed on the label dispensing module 12. As is well known in the art, the label detection sensor 72 is an optical-based sensor which detects the leading edge of a label based on the amount of light passing through the label web 30. The label detection sensor 72 communicates with the microcontroller 70 which in turn drives the drive mechanism 64. The label web 30 is advanced by the drive mechanism 64, such that the leading edge of a label stops at the edge of the peeler wedge 44. In this way, the label is properly positioned so that the next time the label web 30 advances, the label is dispensed onto the vacuum pad of the applicator 28. In other words, the microcontroller 70 starts and stops the drive mechanism 64 based on the optical detection of the next label on the label web 30, thereby dispensing labels to the applicator 28. As will be apparent to one skilled in the art, how far the label web 30 advances between each label depends on the size of the labels and the position of the label detection sensor 72 in relation to the edge of the peeler wedge 44.

Figure 8:
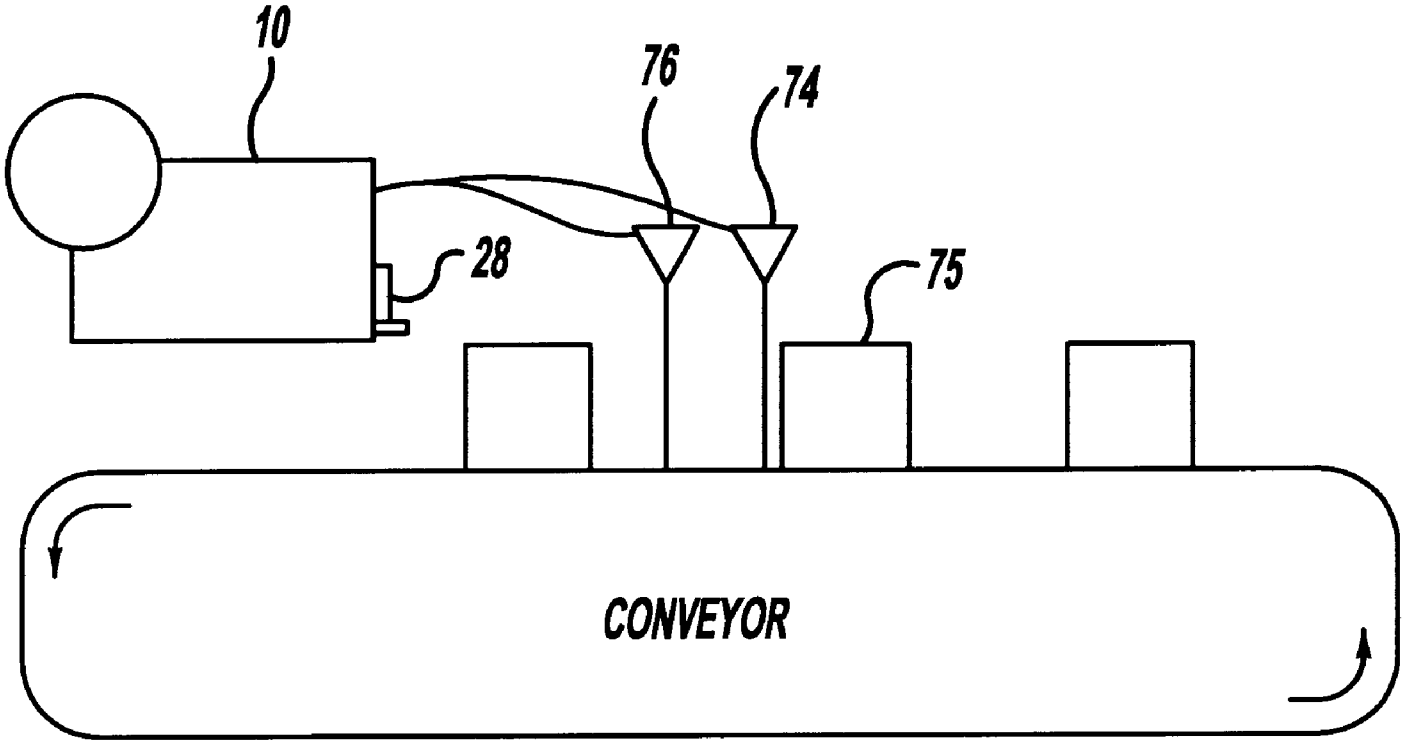
FIG. 8 is a diagram showing product detect sensors in conjunction with the label dispensing apparatus of the present invention.

To further coordinate the functions of the label dispensing apparatus 10, a first product detection sensor 74 is electrically connected to the microcontroller 70. As shown in FIG. 8, the first product detection sensor 74 is positioned upstream from the applicator 28, so that it can detect an article 75 as it approaches the label dispensing apparatus 10. Based on the information provided by the first product detection sensor 74, the microcontroller 70 then coordinates the application of the label to the advancing article by the applicator 28. In order to coordinate between the product detection sensor 74 and the applicator 28, the microcontroller 70 associated with the label dispensing module 12 is designed to interface with the microcontroller of the chassis 14. In this case, the microcontroller 70 assumes a constant speed for the conveyor being used to transport the advancing articles.

However, in an alternative embodiment, a second product detection sensor 76 may be used to dynamically control the operations of the label dispensing apparatus 10 for a variable speed conveyor. Again, the product detection sensor 76 is operative to detect the leading edge of an advancing article and communicate this information to the microcontroller 70. Based on information from each of the two product detection sensors 74 and 76, the microcontroller 70 can then determine the rate at which the advancing articles are approaching the label dispensing apparatus 10. Accordingly, the operations of the drive mechanism 64 and the label applicator 28 are adjusted by the microcontroller 70.

While the above description constitutes the preferred embodiment of the invention, it will be appreciated that the invention is susceptible to modification, variation, and change without departing from the proper scope or fair meaning of the accompanying claims.

We claim:

1. A label dispensing apparatus for applying labels to advancing articles, comprising:

a label dispensing chassis;

a label supply hub coupled to said label dispensing chassis for supplying a label web;

a web rewind hub coupled to said label dispensing chassis for accumulating the label web;

a label applicator positioned along the web path and coupled to said label dispensing chassis for applying labels from the label web to the advancing articles a label dispensing module releasably attachable to said label dispensing chassis, said label dispensing module further includes:

a primary drive roller mechanism receptive of the label web from the label supply roller, said primary drive roller mechanism includes a primary drive roller and a primary pinch roller operating collaboratively to advance the label web along the web path, an edge positioned downstream in the web path from said primary drive mechanism such that the label web traverses the edge to separate the labels from the label web;

a secondary roller mechanism positioned downstream from said edge for maintaining tension on the web, said secondary roller mechanism includes a secondary drive roller and a secondary pinch roller operating collaboratively to advance the label web along the web path; and a drive mechanism connected to the primary drive roller and the secondary drive roller for providing rotary motion to each of the primary drive roller and the secondary drive roller, thereby advancing the label web along the web path.

2. The label dispensing apparatus of claim 1 further comprises a dancer arm coupled to the label dispensing module, the dancer arm receptive of the label web from the label dispensing chassis and pivotally movable based on the tension of the label web.

3. The label dispensing apparatus of claim 1 further comprising a dampener roller coupled to the label dispensing module and positioned between the secondary roller mechanism and the web rewind hub, the dampener roller receptive of the label web and pivotally movable based on the tension of the label web.

4. The label dispensing apparatus of claim 1 wherein a diameter of the secondary drive roller is slightly larger than a diameter of the primary drive roller, thereby maintaining tension on the label web.

5. The label dispensing apparatus of claim 1 wherein the drive mechanism of the label dispensing module is further defined as a stepper motor and a timing belt that connects to each of the primary drive roller and the secondary drive roller, thereby providing rotary motion to each of the primary drive roller and the secondary drive roller.

6. The label dispensing apparatus of claim 1 further comprises:

a label detection sensor for detecting a label on the label web; and a controller connected to the label detection sensor and the drive mechanism for controlling the advancement of the label web through the operation of the drive mechanism, thereby positioning the label at the end of the peeler wedge.

7. The label dispensing apparatus of claim 1 further comprises:

a product detection sensor positioned upstream from label applicator for detecting an article as it approaches the label dispensing apparatus; and a controller electrically connected to the product detection sensor and the label applicator for coordinating the application of a label to the advancing article.

8. The label dispensing apparatus of claim 7 further comprises a second product detection sensor electrically connected to the controller and positioned upstream from label applicator for detecting the article as it approaches the label dispensing apparatus, whereby the controller determines a rate at which the article is approaching the apparatus and coordinates the application of a label to the advancing article based on the rate at which the article is approaching the apparatus.

9. The label dispensing apparatus of claim 1 wherein the label dispensing chassis further includes a cavity dimensioned to receive the label dispensing module and a plurality of apertures positioned adjacent to the cavity.

10. The label dispensing apparatus of claim 9 wherein the label dispensing module further includes a mounting flange disposed around an outer perimeter thereof and a plurality of holes formed in the mounting flange, such that the plurality of holes align with the plurality of apertures formed in the label dispensing chassis, whereby a plurality of fasteners may connect through the plurality of holes to releasably attach the label dispensing module to the label dispensing chassis.

* * * * *